United States Patent [19]

Nakajima et al.

[11] Patent Number: 4,738,607

[45] Date of Patent: Apr. 19, 1988

[54] SPINNERET ASSEMBLY FOR CONJUGATE SPINNING

[75] Inventors: Sadaaki Nakajima; Taiju Terakawa, both of Shiga, Japan

[73] Assignee: Chisso Corporation, Osaka, Japan

[21] Appl. No.: 943,702

[22] Filed: Dec. 19, 1986

[30] Foreign Application Priority Data

Dec. 27, 1985 [JP] Japan ..... 60-293684

[51] Int. Cl.[4] ..... D01D 5/32

[52] U.S. Cl. ..... 425/131.5; 264/171; 425/192 S; 425/463; 425/DIG. 217; 425/198

[58] Field of Search ..... 264/171, 176.1; 425/131.1, 131.5, 190, 192 R, 192 S, 197–199, 382 R, 382.2, 461–467, DIG. 49, DIG. 217

[56] References Cited

U.S. PATENT DOCUMENTS

| | | | |
|---|---|---|---|
| 3,375,548 | 4/1968 | Kido et al. | 425/DIG. 217 |
| 3,466,703 | 9/1969 | Heckrotte | 425/131.5 |
| 3,559,237 | 2/1971 | Biggelaar et al. | 425/131.5 |
| 3,584,339 | 6/1971 | Kamachi et al. | 425/131.5 |
| 3,601,846 | 8/1971 | Hudnall | 426/131.5 |
| 3,704,971 | 12/1972 | Baird et al. | 425/463 |
| 3,792,944 | 2/1974 | Chimura et al. | 425/463 |
| 3,849,044 | 11/1974 | Ando et al. | 425/463 |
| 4,370,114 | 1/1983 | Okamoto et al. | 425/463 |

FOREIGN PATENT DOCUMENTS

| | | | |
|---|---|---|---|
| 1106849 | 3/1968 | United Kingdom | 264/171 |
| 1116823 | 6/1968 | United Kingdom | 264/171 |

*Primary Examiner*—Jeffery Thurlow
*Assistant Examiner*—J. Fortenberry
*Attorney, Agent, or Firm*—Oblon, Fisher, Spivak, McClelland & Maier

[57] ABSTRACT

A spinneret assembly for conjugate spinning includes (1) a spinneret plate provided with a number of spinning holes and (2) a distribution plate superposed closely upon the upper face of the spinneret plate onto which two kinds of spinning liquids are to be fed. The distribution plate is arranged in such a manner that, of separate spinning liquid paths for the two kinds of spinning liquid comprising a number of separate and parallel inlet grooves for receiving individually and alternately the two kinds of spinning liquids fed from above and guide paths for guiding individually the two kinds of spinning liquids fed out of the inlet grooves onto upper openings of the spinning holes in the spinneret plate, a part or whole of each guide path forms a pressure-adjusting means. Liquid storing chambers are provided on the lower face of the distribution plate at positions corresponding to the spinning holes.

6 Claims, 6 Drawing Sheets

SPINNERET ASSEMBLY FOR CONJUGATE SPINNING

BACKGROUND OF THE INVENTION

1. Field of the Invention

The present invention relates to a spinneret assembly for conjugate spinning, which has no substantial influence upon a conjugate ratio in the side-by-side type conjugate spinning, even when there is a more or less variation in the relative position between a spinning plate and a distributing plate superposed closely thereupon due to their getting out of order, and can be increased in size to increase the number of spinning holes and hence the spinning efficiency.

2. Statement of the Prior Art

The production of side-by-side type conjugate fibers from two kinds of thermoplastic resins has been carried out for a long time. Year after year, the side-by-side type conjugate fibers (which may be simply called the conjugate fiber or fibers in the description to follow) have enjoyed steadily increased use as staple fibers.

In general, there are mainly two types of the processes for producing the staple fibers. One process involves effecting spinning at a spinning rate of several hundreds to 3,000 meters per minute, bundling the obtained unstretached fibers and temporarily storing them in a container, and thereafter collecting them together to form a thick tow which is then fed to a stretching step in which the required stretching, crimping, heat-treatment and like treatments were applied, followed by cutting and packaging.

The other process involves effecting spinning at a low spinning rate of several meters to several tens meters per minute, and feeding the thus spinned unstretched fibers directly to a stretching step, not through any storing step, in which a succession of treatments such as stretching, crimping, heat-treatment and cutting are continuously carried out (this step will hereinafter be referred to as the continuous type production process).

The continuous type production process is carried out without any interruption between the spinning step and the stretching step, and is more advantageous than the first-mentioned process in that higher yields are achieved, and containers and working area, installation and labor associated therewith are dispensed with, resulting in a recent tendency for conjugate staple fibers to be produced by that continuous type production process.

The principles of the production of conjugate fibers applied in general are that two kinds of thermoplastic resins are independently made molten by heating to prepare independent spinning liquids, the two liquids are separately fed under pressure to the associated spinning holes by way of independent paths, at or just before which they are combined with each other at a predetermined ratio ( of 1:1 in most cases; the following explanation shall typically be made to the conjugate ratio of 1:1), and the combined liquids are spun out of the spinning holes, followed by the given steps.

Reference will now be made to one typical example of the spinneret assembly heretofore used for spinning conjugate fibers with reference to the drawings. The spinneret assembly for spinning conjugate fibers may simply be called the spinneret assembly in the description to follow.

Referring to FIG. 9(*a*), a spinning plate 1 includes therein a number of spinning holes 2. Usually, the multiplicity of spinning holes 2 are formed in a plurality of rows that are parallel with each other in at least one direction, and are disposed at equal intervals. A distribution plate 8 is superposed on and brought into close contact with the upper face of the spinning plate 1, to which the spinning liquid are to be fed. Of separate spinning liquid paths comprising a number of inlet grooves 9 disposed in parallel so as to receive separately and alternatively two kinds of spinning liquid A and B fed from above and guide paths C for guiding independently the liquid A and B leaving the inlet grooves 9 into the upper openings 2*a* of the respective spinning holes 2 in the spinning plate 1, at least the guide paths C are provided to the distribution plate 8. It is noted in this connection that a part or whole of each guide path C forms pressure-adjusting means or holes 10. In the assembly of FIG. 9, the inlet grooves 9 are also provided in the distribution plate 8. In the distribution plate 8 used with the conventional spinneret assembly, the endmost portion of guide path C is practically bifurcated in outlet grooves 11 extending over the adjacent two rows of spinning holes 2 of the spinning plate 1, as illustrated in FIG. 9(*a*). The pressure-adjusting means or holes 10 is then formed between the inlet and outlet grooves 9 and 11 in the guide path C. In this case, the lower end portion of a partition wall 12 for spacing an outlet groove 11 away from the adjacent outlet groove 11 serves to divide an upper open portion 2*a* of each row of spinning holes 2 at its central portion into equal left and right subportions 2*a*′ and 2*a*″. As illustrated in FIG. 9(*a*), therefore, the spinning liquid A and B regulated in respect of pressure in the associated guide paths C are fed into one spinning hole 2. Thus the spinning liquid A or B regulated in respect of pressure in one guide path C is branched out at the endmost portion of that guide path C and guided into the adjacent rows of spinning holes 2. In this manner, the two kinds of spinning liquid A and B are spinned out of one spinning hole 2 without being mixed together, thus giving the side-by-side type conjugate structure.

One example of the conventional spinneret assembly having such a main structure as mentioned above will be explained with reference to FIGS. 10 and 11 (corresponding to the sectional direction in FIG. 9). Superposed upon the spinning plate 1 is the distribution plate 8 including therein the inlet grooves 9 to which the two kinds of spinning liquid A and B may individually and alternately be fed according to any of the known techniques. In the example illustrated, a distribution-aiding plate 13, shown in FIG. 12, is placed upon the distribution plate 8 as the auxiliary plate designed to this end, upon which a filter 14 is further superposed for the purpose of removing foreign matters from the spinning liquid. These parts are housed within a spinneret cap 15, as disclosed in FIG. 10. All the parts but the filter 14 are accurately positioned by set pins to locate the lower end portion of the partition wall 12 at the middle of the upper opening portion 2*a* of the spinning hole 2 of the spinning plate 1. The spinning liquids A and B are respectively fed from the associated inlet ports 15*a* and 15*b* formed in the spinneret cap 15, and are stored in left and right top reservoir chambers 16 and 16′ defined by a separation wall 15*c* extending from the inside of the top portion of the cap 15, whence they are supplied to the distribution plate 8 successively through the filter 14 and the distribution-aiding plate 13. The distribution-aiding plate 13 is provided therein with a number of inlet holes 13*a*, which are of the arrangement that they are divided into the left and right groups along the center line zone thereof, and that, when the distribution-aiding plate 13 is superposed upon the distribution plate 8 with the center line zone crossing at right angles to the inlet grooves 9, such inlet holes 13*a* are linearly located at the respective positions corresponding to the respective inlet grooves 9, and alternate in the left and right groups. The separation wall 15*c* of the spinneret cap 15 is allowed to engate at its lower end portion with that center line zone through the filter 14. Consequently, when the two kinds of spinning liquid A and B are individually fed to the distribution plate 8 through the distribution-aiding plate 13, as stated above, they are introduced into the multiplicity of inlet grooves 9 disposed in parallel in the distribution plate 8 in the way of alternating the inlet groove 9 into which spinning liquid A is introduced with the inlet groove 9 into which spinning liquid B is introduced, pass through the pressure adjusting means or holes 10 and outlet grooves 11, and are spinned out of the spinning holes 2 to give a conjugate structure comprising the components A and B.

As the aforesaid conventional spinneret assembly is repeatedly used over an extended period of time, the stack of the spinneret plate 1, the distribution plate 8, the spinneret cap 15 and the like becomes out of order due to the deformation and thinning of the set pins, the distortion and thermal expansion of the spinneret plate 1, the distribution plate 8 and the spinneret cap 15, etc. The result is that the spinneret plate 1 is horizontally displaced with respect to the distribution plate 8, and vice versa. Where such displacement takes place along the lengthwise direction of the partition wall 12, it has not any influence upon the conjugate ratio, since the fiber takes on the same sectional shape as shown in FIG. 9(*b*),(*c*). This is because the relation in position between the partition wall 12 of the distribution plate 8 and the spinning hole 2 in the spinneret plate 1 is in a normal state as shown in FIG. 9(*a*). However, where the displacement occurs in the direction crossing the lengthwise direction of the partition wall 12 of the distribution plate 8, it exerts an influence upon the conjugate ratio, since the relation in position between the partition wall 12 and the spinning hole 2 varies, as shown in FIG. 13(*a*). Particularly when it is intended to produce the staple fibers of conjugate fibers by the aforesaid continuous process, noticeable influences are exerted upon the conjugate ratio and, in some cases, upon the divided state, i.e., conjugate structure of the composite components A and B in the fiber section. Since the continuous process is of a low productivity per spinning hole 2 due to its low spinning rate, it is required to increase the spinning rate and use as many spinning holes as possible for instance, in the order of several thousands of spinning holes per spinneret assembly. To realize this, the overall size of the spinneret assembly should be increased, thus resulting in an increase in the displacement.

When the positional relation between the partition wall 12 and the spinning hole 2 varies in this manner, there is a variation in the amount of the spinning liquid A or B formed from one outlet groove 11 into the two spinning holes 2 under the same pressure, the above mentioned variation depending upon a variation in the size of the two upper opening subportions 2*a*′ and 2*a*″ positioned on the left and right sides of one spinning hole 2 as shown in FIG. 13(*a*). Thus, the spinning liquid A and B are forced into one spinning hole 2 in varied amounts. As will be appreciated from FIGS. 13(*b*) and (*c*) showing the sections of the fibers upon being spinnned out, therefore, the conjugate ratio of the components A and B does not only depart largely from 1:1, but the conjugate structure is also affected. The prior art spinneret assembly has offered such problems.

OBJECT OF THE INVENTION

A main object of the present invention is to provide a spinneret assembly for conjugate spinning, which is freed of the technical problems as mentioned above, and which has no substantial influence upon the conjugate ratio, even when a spinneret plate and a distribution plate, stacked one upon the other, become out of order and are more or less displaced with respect to each other.

SUMMARY OF THE INVENTION

According to the present invention, this object is achieved by the provision of a spinneret assembly for conjugate spinning, including (1) a spinneret plate provided with a number of spinning holes and (2) a distribution plate superposed closely upon the upper face of said spinneret plate onto which two kinds of spinning liquid are to be fed, and arranged in such a manner that, of separate spinning liquid paths for said two kinds of spinning liquids comprising a number of separate and parallel inlet grooves for receiving individually and alternately said two kinds of spinning liquid fed from above and guide paths for guiding individually said two kinds of spinning liquid fed out of said inlet grooves onto upper openings of said spinning holes in said spinneret plate, it is provided with at least said guide paths, a part or whole of each of which forms a pressure-adjusting means or holes, wherein:

liquid storing chambers are provided on the lower face of said distribution plate at positions corresponding to said spinning holes, each of said liquid storing chambers being recessed at the upper portion and having at least one diameter longer than the diameter of the upper openings of the corresponding spinning holes, each of said liquid storing chambers being provided with two guide paths for guiding said two kinds of spinning liquids fed individually out of the adjacent two inlet grooves to both ends of said longer diameter of each of said liquid storing chambers, and a part or whole of each of said guide paths extending to both ends of each of said liquid storing chambers forming pressure-adjusting means or holes having a cross-sectional area smaller than the cross-sectional area of each of said liquid storing chambers perpendicular to said longer diameter.

BRIEF DESCRIPTION OF THE DRAWINGS

The aforesaid and other objects as well as the features of the invention will become apparent from the following detailed description with reference to the accompanying drawings, in which.

DETAILED DESCRIPTION OF THE INVENTION

The structure of the present invention will be explained in further detail with reference to the drawings.

Referring to FIGS. 1 to 8, a spinneret plate generally shown at 1 is provided with a number of spinning holes 2. The spinneret plate 1 is similar to the spinneret plate 1 used in the prior art in that the multiplicity of spinning holes 2 are arranged at equal intervals and in a plurality of rows which are in parallel at least in one direction. According to the present invention, however, any particular limitations are not imposed upon the pitch and density of spinning holes, and the spinning holes may actually be used at a density of 100 holes/cm$^2$ (corresponding to a pitch of about 0.8 mm$\times$1.2 mm).

Figure 1:
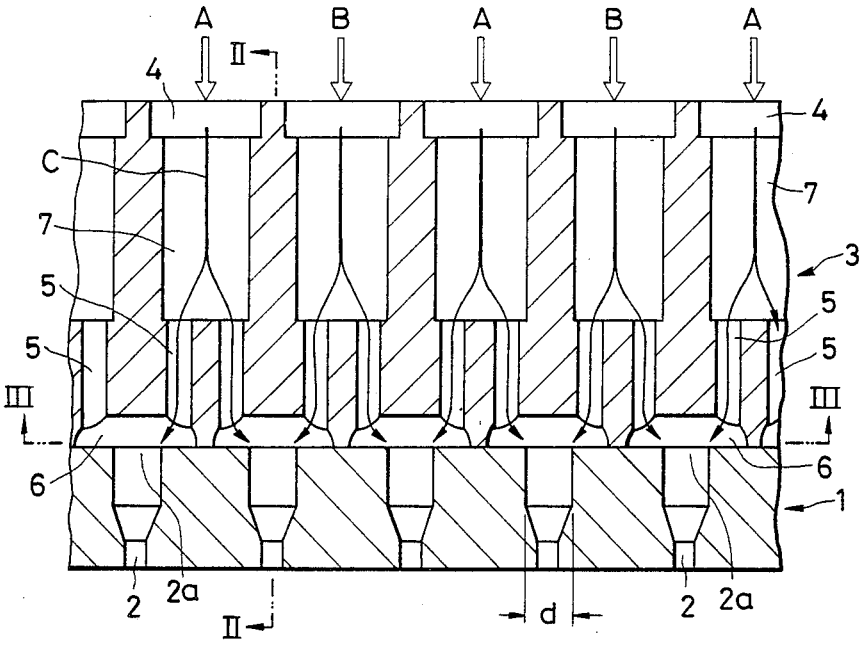
FIG. 1 is a sectional view illustrating in principle the primary structure of one embodiment of the spinneret assembly according to the present invnetion.
Figure 2:
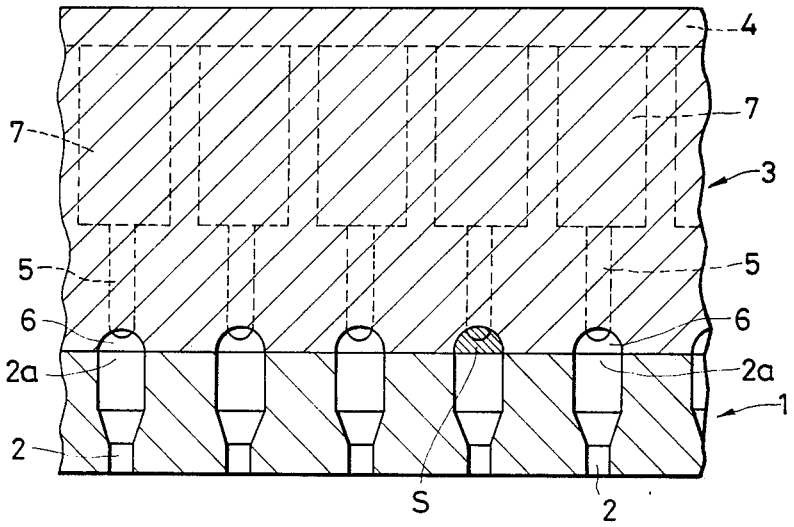
FIG. 2 is a sectional view taken along the line II—II of FIG. 1.
Figure 3:
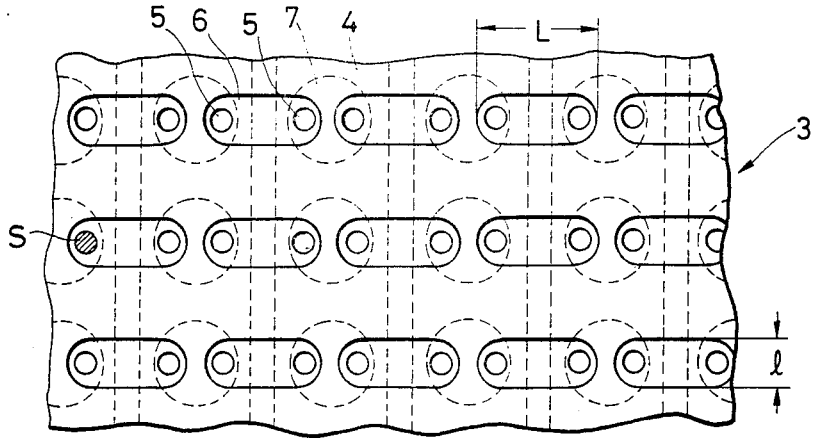
FIG. 3 is a sectional view taken along the line III—III of FIG. 1, FIG. 4(*a*) is a view illustrating a state where the spinneret plate is relatively displaced with respect to the distribution plate in the normal state of FIG. 1, FIGS. 4(*b*) and (*c*) are sectional views illustrating schematically the sections of the fibers corresponding to the just above hole in FIG. 4(*a*), FIG. 5(*a*) is a view illustrating a state where the spinneret plate is relatively displaced with respect to the distribution plate in the state of FIG. 2, FIG. 5(*b*) is a sectional view showing schematically the section of the fiber corresponding to the just above hole in FIG. 5(*a*)

A distribution plate generally shown at 3 is superposed closely upon the upper face of the spinneret plate 1 onto which spinning liquids are to be fed. The distribution plate 3 is similar to the distribution plate 13 in the prior art in that, of separate spinning liquid paths comprising a number of inlet grooves 4 disposed in parallel so as to receive independently and alternately two kinds of spinning liquid A and B fed from above and guide paths C for guiding independently the spinning liquid A and B fed from the grooves 4 onto an upper opening 2*a* of each spinning hole 2 in the spinneret plate 1, it is provided with at least the guide paths C, a part or whole of each of which forms a pressure-adjusting means or holes 5. Although not illustrated, the inlet grooves 4 are not necessarily formed in the distribution plate 3. For instance, a member having slits corresponding to the inlet grooves 4 maybe provided separately from the distribution plate 3. Alternatively, such a member may be provided on the lower side of the aforesaid distribution-aiding plate 13. It is noted, however, that the spinneret assembly of the present invention is characterized in that the distribution plate 3 used therein is of the following construction. That is, a liquid storing chamber 6 is provided on the lower face of the distribution plate 3 at a position corresponding to each spinning hole 2 in the spinneret plate 1, as illustrated in FIGS. 1 and 2, said chamber 6 being recessed at its upper portion and having at least one dimension L (hereinafter sometimes called the longer dimension) longer than the diameter d of an upper opening (usually of a circular shape) of the corresponding spinning hole 2. Each liquid storing chamber 6 is provided with two paths for guiding the two kinds of spinning liquids A and B individually fed out of the adjacent two inlet grooves 4 and 4 to both ends of the longer dimension L thereof. These paths form the guide path C for guiding two kinds of spinning liquid with the liquid storing chamber 6. The guide path C then comprises separate path extending to the liquid storing chamber 6, in one case from the outset, and in the other case being branched after common path section having a larger diameter (to be described later), and a part or whole of each of said separate path form the presure-adjusting means or holes 5. In this case, the pressure-adjusting means or holes 5 are selected such that its cross-sectional area s is smaller than the cross-sectional area S perpendicular to the longer dimension L of the liquid storing chamber 6.

In the present invention, the guide paths C for guiding the two kinds of spinning liquid A and B fed out of the respective inlet grooves 4 onto the upper openings 2*a* of the respective spinning holes 2 by way of the liquid storing chambers 6 are thus arranged for the respective spinning hole rows. Then, two guide paths for the spinning liquid A or B fed out of one inlet groove 4 into the left and right liquid storing chambers 6 and 6 are formed as the path sections of each guide path C extending from the inlet groove 4 to both ends of the longer dimension L of the liquid storing chamber 6. However, it is not required than the left and right path sections be formed separately from the outset of the guide path C. It is rather preferable that a larger-diameter guide path 7 located on the side of the inlet groove 4 is first provided, and is then branched at its lower end to form the left and right path sections terminating at the adjacent liquid storing chambers 6 as shown in FIG. 1, since the flow of the spinning liquid A or B becomes more stable, and the distribution plate 3 is easier to manufacture. To attain a sufficient pressure on the side of the larger-diameter guide path 7 or the inlet groove 4, the diameter and length of the pressure-adjusting means or holes 5 should be determined depending upon the type of thermoplastic resin used and the spinning conditions involved. The relation in size between the liquid storing chambers 6 and the upper openings 2*a* of the spinning holes 2 in the spinneret plate 1 may be selected such that at least one dimension L of each chamber 6 is larger than the diameter d of the upper opening 2*a* of the spinning hole 2. The other dimension l (hereinafter sometimes called the shorter dimension) may be equal to (see FIG. 7(*a*)), smaller than (see FIGS. 7 (*b*) and (*c*)) or larger than (provided that it should be smaller than L) the diameter d of the upper opening 2*a*.

Figure 11:
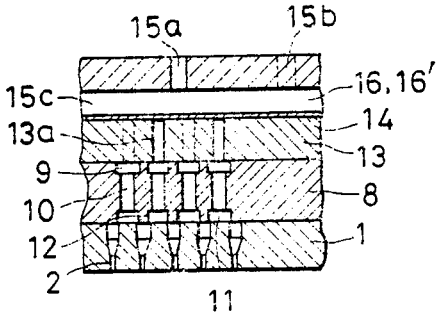
FIG. 11 PRIOR ART
FIG. 11 is a sectional view taken along the line XI—XI of FIG. 10, in which some repeating units are omitted.
Figure 12:
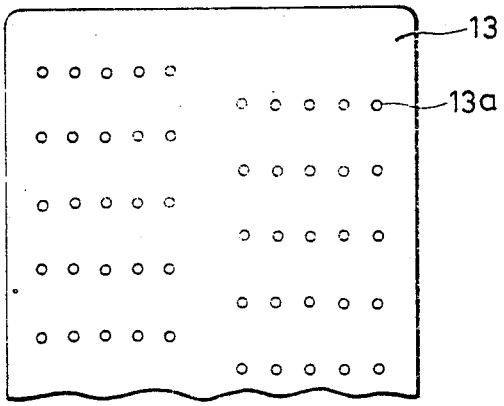
FIG. 12 PRIOR ART
FIG. 12 is a plan view showing a distribution aiding plate used in FIGS. 10 and 11.
Figure 13:
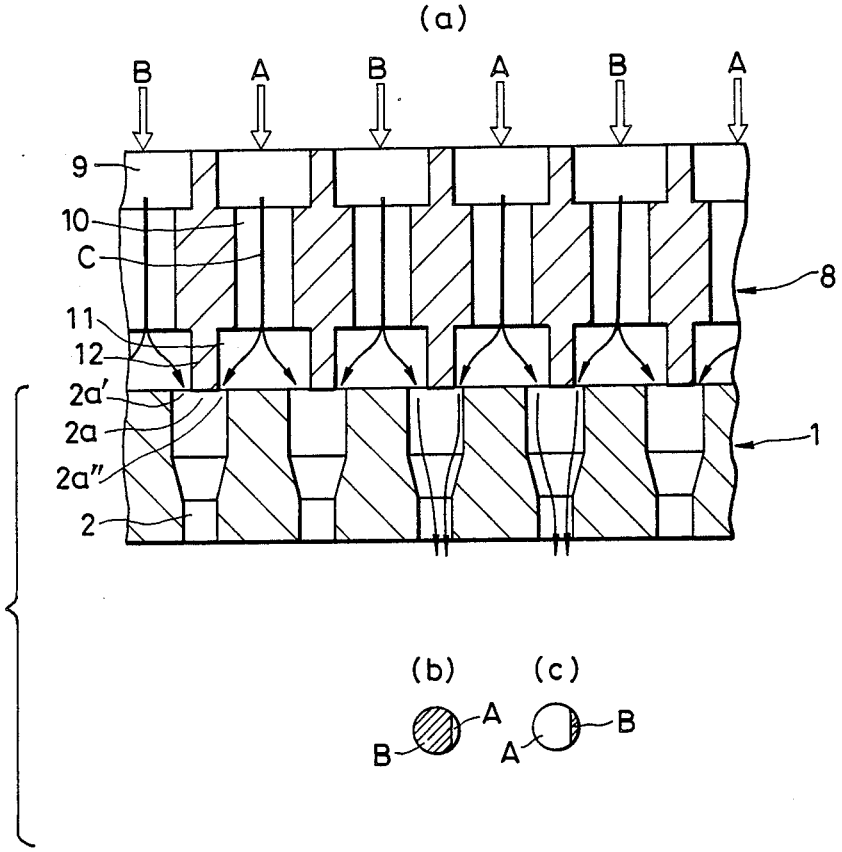
FIG. 13 PRIOR ART
FIG. 13(*a*) shows a variation in the relative position between the upper and lower parts illustrated in FIG. 9(*a*), and FIGS. 13(*b*) and 13(*c*) are schematic views each illustrating the section of the fiber corresponding to the just above hole in FIG. 13(*a*).

An example of the spinneret assembly in which the distribution plate 3 constructed as mentioned above is used is shown in FIG. 8 at an enlarged scale, corresponding to FIG. 11 showing a concrete example of the prior art spinneret assembly.

Figure 4:
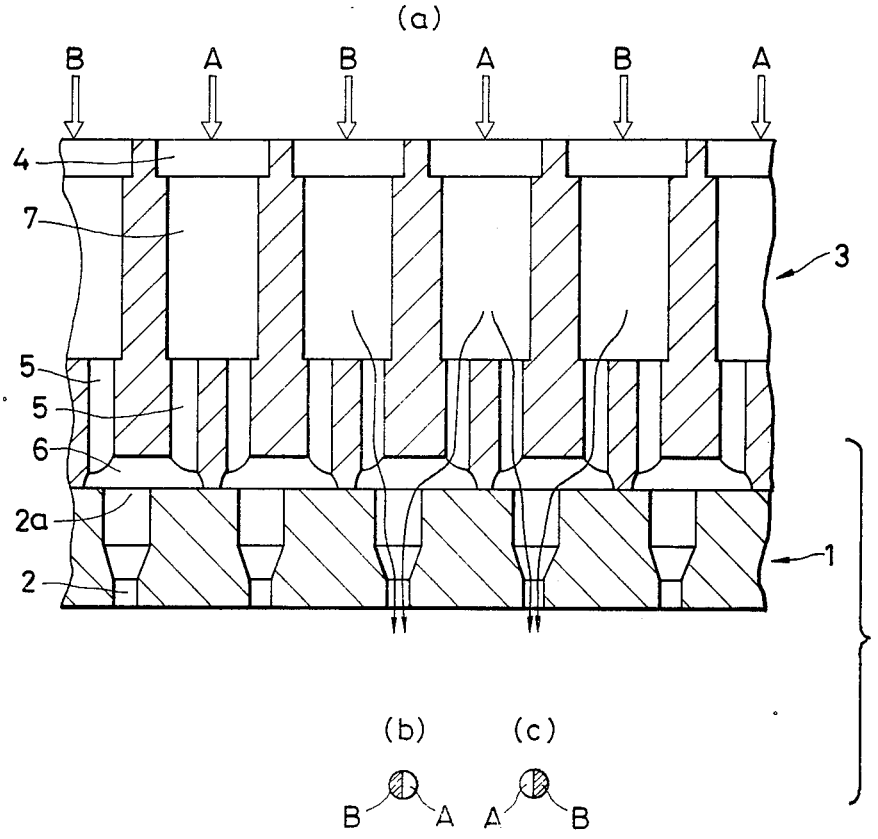
Figure 5:
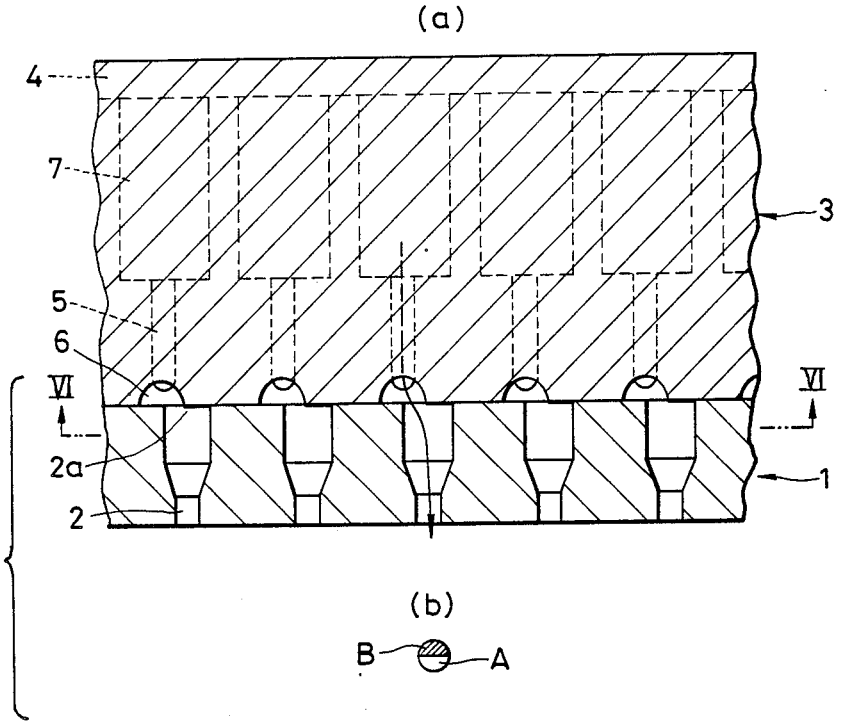
Figure 6:
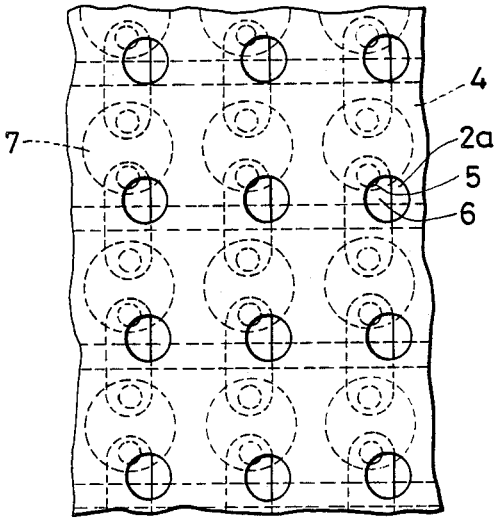
FIG. 6 is a sectional view taken along the line VI—VI of FIG. 5(*a*), FIG. 7(*a*), (*b*) and (*c*) are sectional views taken along the same line as in FIG. 6, showing the relations in size and position alone between an upper opening of a spinning hole of the spinneret plate and a liquid storing chamber of the distribution plate.
Figure 7:
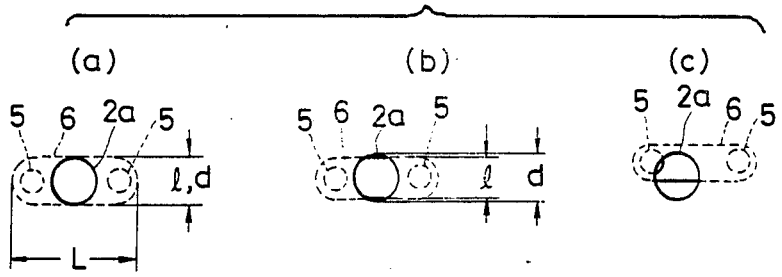
Figure 8:
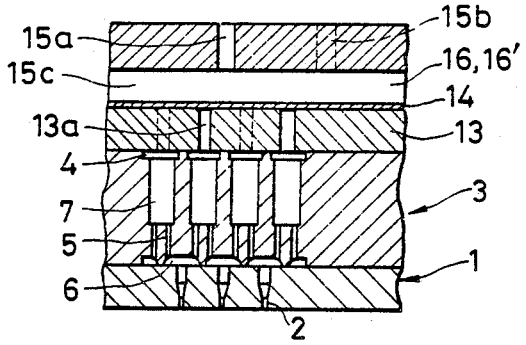
FIG. 8 is a sectional view illustrating partly one example of the spinneret assembly according to the present invention, in which some repeating units are omitted, FIG. 9(*a*) illustrates in principle the main structure of the conventional spinneret assembly in its normal state where the upper and lower parts are positioned in order, FIG. 9(*b*) and (*c*) are schematic views each illustrating the section of the fiber corresponding to the just above hole in FIG. 9(*a*).
Figure 9:
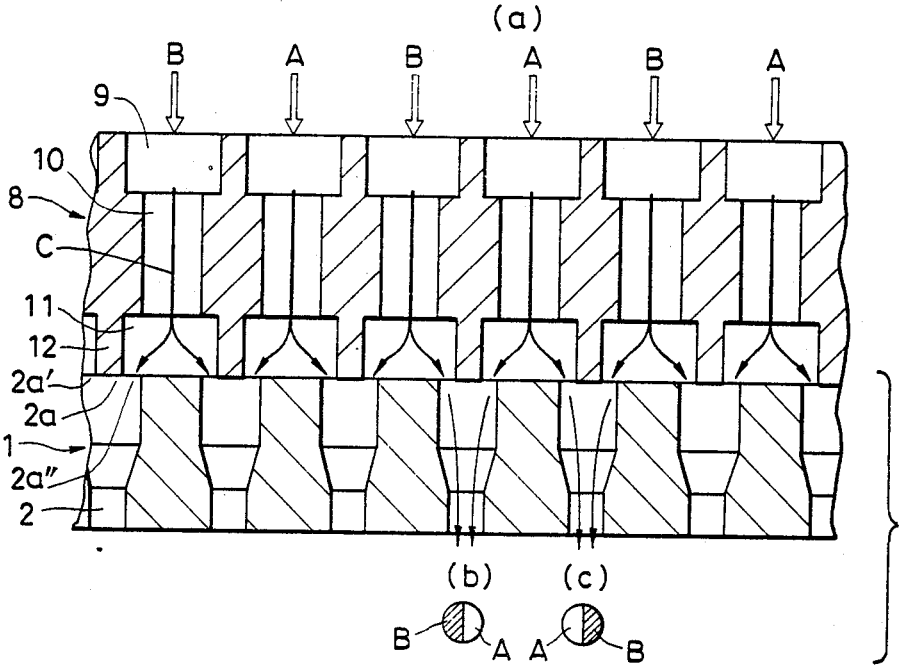
FIG. 9 PRIOR ART
Figure 10:
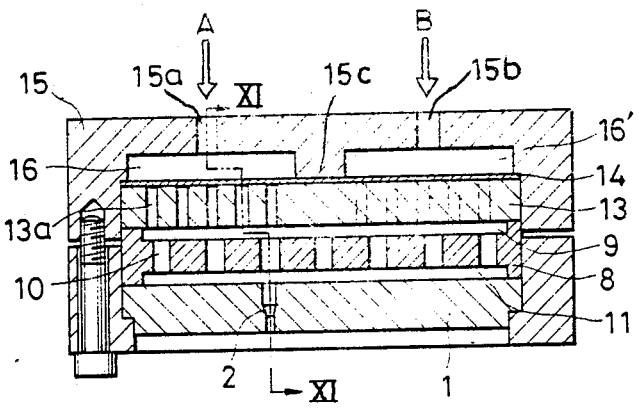
FIG. 10 PRIOR ART
FIG. 10 is a sectional view of an example of the spinneret assembly of the main structure illustrated in FIG. 9(*a*)

In using the spinneret assembly of the present invention, the upper opening 2*a* of the spinning hole 2 is positioned at the center of the longer dimension L of the liquid storing chamber 6, when no displacement occurs between the spinneret plate 1 and the distribution plate 3. It is to be understood that no closure is found between the liquid storing chamber 6 and the upper opening 2*a* of the spinning hole 2, even though the shorter dimension l of the liquid storing chamber 6 is equal to the diameter d of the upper opening 2*a* of the spinning hole 2 (as illustrated in FIG. 7(*a*)) or smaller than d (as illustrated in FIG. 7(*b*)). Even if such displacement as illustrated in FIG. 4(*a*) or 5(*a*) occurs between the spinneret plate 1 and the distribution plate 3, sufficient communication is assured therebetween due to the fact that they overlay at least partly with each other and the liquid storing chamber 6 is recessed at its upper portion, unless such displacement comes to an extreme. Even if such displacement gives rise to a difference in the distance from the outlet of the pressure-adjusting means or holes 5 to the upper opening 2*a* of the corresponding spinning hole 2, it has no substantial influence upon the conjugate ratio achieved and conjugate structure obtained in the respective spinning holes 2, as shown in FIGS. 4(*b*) and (*c*) and FIG. 5(*b*). The reasons are that:

The pressure-adjusting means or holes 5 is provided in the course of the guide path C extending to the liquid storing chamber 6 to give out a sufficient pressure difference in front and in rear thereof, which serves to make uniform the flow rate of spinning liquids flowing therethrough;

The cross-sectional area S of the liquid storing chamber 6 perpendicular to the longer dimension L is made larger than the cross-sectional area s of the pressure-adjusting means or holes 5, whereby it is possible to decrease the resistance to the flow of the spinning liquid A and B from the outlet of the pressure-adjusting means or holes 5 to the upper opening 2*a* of the spinning hole 2 and thereby more effectively make uniform the flow rate of spinning liquids flowing through the pressure-adjusting means or holes 5; and The longer dimension L of the liquid storing chamber 6 is made longer than the diameter d of of the upper opening 2*a* of the spinning hole 2, whereby the two outlets of the pressure-adjusting means holes 5, which are open at the both ends of the longer dimension L, are constantly and substantially opposite to each other on both sides of the middle portion of the upper opening 2*a*, even when there is a more or less variation in position between the spinneret plate 1 and the distribution plate 3.

Consequently, the spinning liquid A and B fed under pressure to both ends of the longer dimension L of the liquid storing chamber 6 are forced into the upper opening 2*a* of the spinning hole 2 in an extremely stable manner. The larger the cross-sectional area S of the liquid storing chamber 6, the less the influence exerted by a difference in the distance from the two outlets of the pressure-adjusting means or holes 5 to the upper opening 2*a* of the spinning hole 2, said difference being brought about by displacement or positional variation.

According to the spinneret assembly of the present invention, even when it becomes out of order due to its repeated operation over an extended period of time so that there is a more or less variation in position between the spinneret plate and the distribution plate, such positional variation has no substantial influence upon not only the conjugate structure but also the conjugate ratio in the parallel type conjugate spinning. Thus, the spinneret assembly of the present invention can be increased in size with increases in the number of spinning holes to be used, and can therefore be operated with higher efficiency.

It is to be understood that many modifications or changes may be made without departing from the spirit and scope of the appended claims.

We claim:

1. A spinneret assembly for conjugate spinning, said spinneret assembly comprising:

(a) a distribution plate having:

(i) an upper face and a planar lower face;

(ii) a plurality of first guide paths for a first spinning liquid extending from the upper face of said distribution plate part way through said distribution plate;

(iii) a plurality of second guide paths for a second spinning liquid extending from the upper face of said distribution plate part way through said distribution plate;

(iv) a plurality of liquid storing chambers open to the lower face of said distribution plate, said plurality of liquid storing chambers being spaced from one another and each of said plurality of liquid storing chambers having a longer dimension L and a shorter dimension 1 in the cross-section congruent with the lower face of said distribution plate;

(v) a first pressure-adjusting hole leading from each of said first guide paths to a corresponding first one of said plurality of liquid storing chambers near a first end thereof;

(vi) a second pressure-adjusting hole leading from each of said first guide paths to a corresponding second one of said plurality of liquid storing chambers near a first end thereof;

(vii) a third pressure-adjusting hole leading from each of said second guide paths to a corresponding second one of said plurality of liquid storing chambers near a second end thereof; and (viii) a fourth pressure-adjusting hole leading from each of said second guide paths to a corresponding third one of said plurality of liquid storing chambers near a second end thereof; and (b) a spinneret plate having:

(i) a planar upper face in surface abutting contact with the planar lower face of said distribution plate and a lower face and (ii) a plurality of spinning holes extending from the upper face of said spinneret plate to the lower face of said spinneret plate, each one of said plurality of spinning holes having a single upper opening in the upper face of said spinneret plate in fluid communication with a corresponding one of said plurality of liquid storing chambers and a single lower opening in the lower face of said spinneret plate through which the mixed liquids are expelled, the longest dimension of the upper opening of each one of said plurality of spinning holes in its cross-section congruent with the upper face of said spinneret plate being less than the longer dimension L, (c) said plurality of guide paths and said first, second, third, and fourth pressure-adjusting holes all being straight and perpendicular to the planar abutting surfaces of said distribution plate and said spinneret plate.

2. A spinneret assembly as recited in claim 1 wherein the longest dimension of the upper opening of each one of said plurality of spinning holes in its cross-section congruent with the upper face of said spinneret plate is less than the shorter dimension 1.

3. A spinneret assembly as recited in claim 1 wherein the longest dimension of the upper opening of each one of said plurality of spinning holes in its cross-section congruent with the upper face of said spinneret plate is equal to the shorter dimension 1.

4. A spinneret assembly as recited in claim 1 wherein the longest dimension of the upper opening of each one of said plurality of spinning holes in its cross-section congruent with the upper face of said spinneret plate is greater than the shorter dimension 1.

5. A spinneret assembly as recited in claim 1 wherein the upper opening of each one of said plurality of spinning holes is round in its cross-section congruent with the upper face of said spinneret plate.

6. A spinneret assembly as recited in claim 1 wherein said distribution plate further has a plurality of inlet grooves in its upper face, each one of said inlet grooves being in fluid communication with a plurality of said guide paths.

* * * * *